US010760284B2

(12) United States Patent
Bordin

(10) Patent No.: US 10,760,284 B2
(45) Date of Patent: Sep. 1, 2020

(54) KNOB FOR LEVELING SPACER FOR LAYING WALL TILES, FLOOR TILES AND THE LIKE

(71) Applicant: PROGRESS PROFILES SPA, Asolo (IT)

(72) Inventor: Dennis Bordin, Asolo (IT)

(73) Assignee: PROGRESS PROFILES SPA, Asolo (IT)

( * ) Notice: Subject to any disclaimer, the term of this patent is extended or adjusted under 35 U.S.C. 154(b) by 0 days.

(21) Appl. No.: 16/243,629

(22) Filed: Jan. 9, 2019

(65) Prior Publication Data

US 2019/0218789 A1 Jul. 18, 2019

(30) Foreign Application Priority Data

Jan. 12, 2018 (IT) ..... 202018000000694

(51) Int. Cl.

| | |
|---|---|
| ***E04F 21/20*** | (2006.01) |
| ***E04F 15/02*** | (2006.01) |
| ***E04F 21/18*** | (2006.01) |
| ***E04F 21/00*** | (2006.01) |
| ***E04F 13/08*** | (2006.01) |
| ***E04F 13/21*** | (2006.01) |

(52) U.S. Cl.

CPC .... *E04F 15/02022* (2013.01); *E04F 13/0862* (2013.01); *E04F 13/21* (2013.01); *E04F 21/0092* (2013.01); *E04F 21/1877* (2013.01)

(58) Field of Classification Search

CPC . E04F 15/02022; E04F 13/0862; E04F 13/21; E04F 21/0092; E04F 21/1877; E04F 21/20

See application file for complete search history.

(56) References Cited

U.S. PATENT DOCUMENTS

| | | | | |
|---|---|---|---|---|
| 9,279,259 | B1 * | 3/2016 | Russo | E04F 21/20 |
| 2016/0369518 | A1 * | 12/2016 | Sarajian | E04F 21/22 |

FOREIGN PATENT DOCUMENTS

| | | | |
|---|---|---|---|
| EP | 2241702 | A2 | 10/2010 |
| EP | 2952652 | A1 | 12/2015 |
| EP | 2966238 | A1 | 1/2016 |
| EP | 3106586 | A2 | 12/2016 |
| WO | 2018172802 | A1 | 9/2018 |

OTHER PUBLICATIONS

Extended European Search Report dated Apr. 3, 2019 re: Application No. EP 19150996.7, pp. 1-9, citing: EP 2 966 238 A1, EP 2 952 652 A1, EP 3 106 586 A2, EP 2 241 702 A2 and WO 2018/172802 A1.

* cited by examiner

*Primary Examiner* — Patrick J Maestri
(74) *Attorney, Agent, or Firm* — Cantor Colburn LLP

(57) ABSTRACT

A knob for a leveling spacer for laying wall tiles, floor tiles, and the like, the spacer being of the type having a base with spacing raised portions for the abutment of the edges of corresponding tiles and a stem, and the knob is provided with circumferential openings on the side wall.

6 Claims, 2 Drawing Sheets

KNOB FOR LEVELING SPACER FOR LAYING WALL TILES, FLOOR TILES AND THE LIKE

CROSS REFERENCE TO RELATED APPLICATIONS

This application is related to, and claims the benefit of, Italian Patent Application No. 202018000000694, filed on Jan. 12, 2018, the contents of which are herein incorporated by reference in their entirety.

TECHNICAL FIELD

The present disclosure relates to a knob for a leveling spacer for laying wall tiles, floor tiles and the like with the interposition of gaps.

BACKGROUND

The laying of floor pavings and wall claddings composed of wall tiles, floor tiles or slabs of medium and large dimensions with reduced or recessed thickness entails considerable difficulties in the steps of leveling the laying and of arranging the tiles at equal distances to provide the gaps.

In order to ensure adequate relative arrangement between the tiles and give uniform leveling to the floor, tools provided specifically to achieve this goal are normally used.

One type of tools of this type comprises a leveling element and a knob.

The leveling element is constituted by a base which is inserted below the corners of, for example, four tiles being laid, from which four spacing raised portions extend for abutment of the edges of the corresponding tiles.

A threaded stem protrudes centrally from the base in a direction that is perpendicular to the plane of the base.

The knob is screwed onto the threaded stem and is substantially cylindrical with a central female thread portion adapted for the insertion of the stem. The female thread portion is axially symmetrical and its axis coincides with the axis of extension of the knob.

The knob has a flat part which is adapted to press on the tiles in order to lock and align the edges and the corners of the tiles arranged on the base of the leveling element.

After laying, the knob, coupled to the stem, is removed by applying pressure in a direction that is perpendicular to the direction of the stem.

Preweakened points provided on the base proximate to the spacing raised portions facilitate the separation of the stem from the base.

The base and the spacing raised portions are embedded and concealed by the paste with which the gaps are subsequently provided.

However, these known methods have aspects that can be improved.

The knob has a substantially cylindrical body and does not allow visual contact with the corners of the tiles that must be aligned.

Furthermore, the substantially cylindrical shape can cause difficult removal of the knob after leveling.

SUMMARY

The aim of the present disclosure is to provide a knob for leveling spacer for laying wall tiles, floor tiles and the like with the interposition of gaps that is capable of improving the background art in one or more of the aspects indicated above.

Within this aim, the disclosure provides a knob for leveling spacer for laying wall tiles, floor tiles and the like with the interposition of gaps that allows to visually check the alignment of the tiles.

The disclosure further provides a knob for leveling spacer for laying wall tiles, floor tiles and the like with the interposition of gaps that allows convenient and easier removal of the spacer after laying with respect to those of the known type.

The disclosure also provides a knob for leveling spacer for laying wall tiles, floor tiles and the like with the interposition of gaps that is highly reliable, relatively easy to provide and at competitive costs.

This aim, as well as these and other advantages which will become better apparent hereinafter, are achieved by providing a knob for leveling spacer for laying wall tiles, floor tiles and the like, said spacer being of the type comprising a base with spacing raised abutment portions for the edges of corresponding tiles and a stem, said knob being characterized in that it is provided with circumferential openings on the side wall.

BRIEF DESCRIPTION OF THE DRAWINGS

Further characteristics and advantages of the disclosure will become better apparent from the description of a preferred but not exclusive embodiment of the knob for leveling spacer for laying wall tiles, floor tiles and the like according to the disclosure, illustrated by way of nonlimiting example in the accompanying drawings, wherein.

DETAILED DESCRIPTION OF THE DRAWINGS

Figure 1:
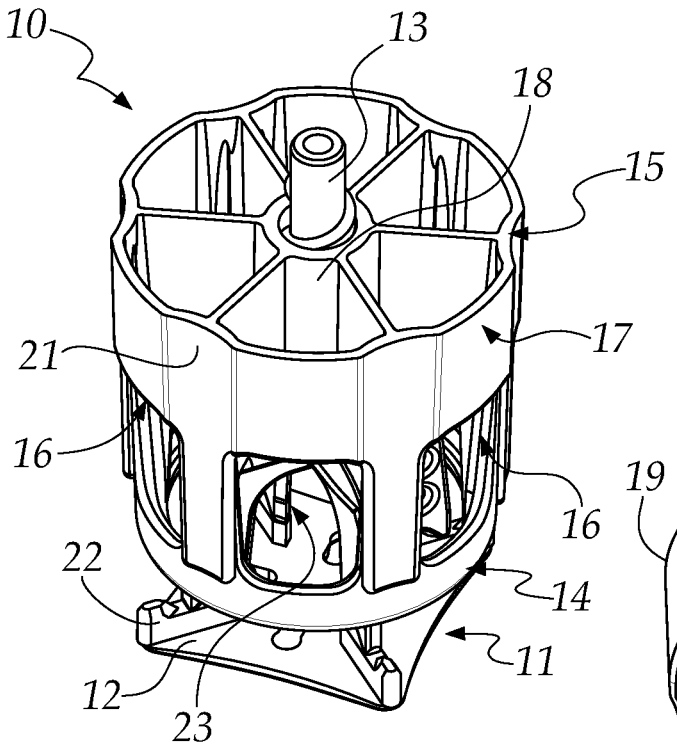
FIG. 1 is a view of a leveling spacer for laying tiles and the like with a knob according to the disclosure.
Figure 2:
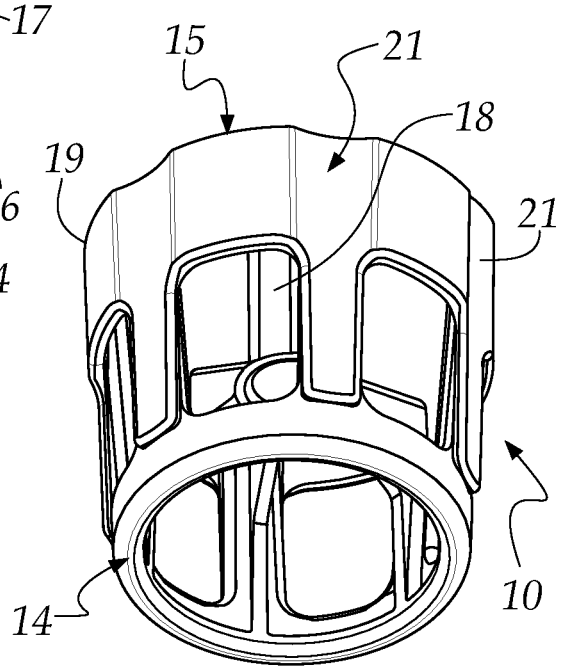
FIG. 2 is a different perspective view of the knob of FIG. 1.
Figure 3:
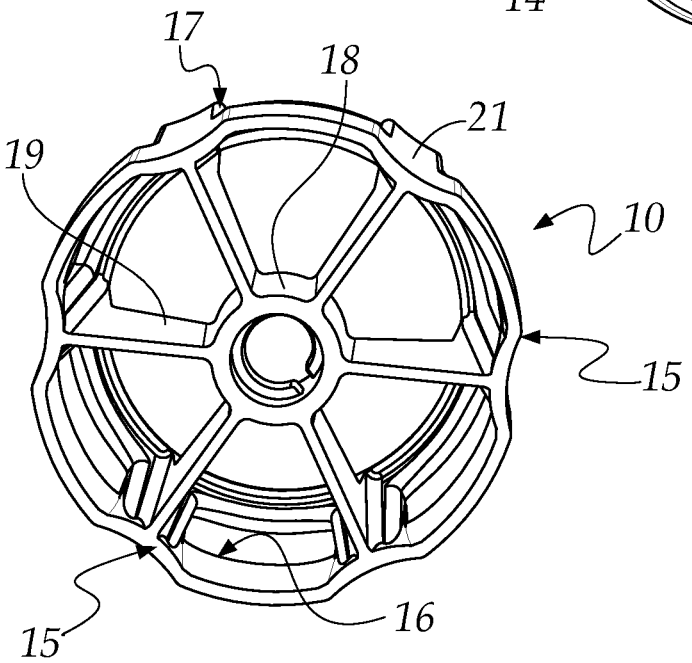
FIG. 3 is another perspective view of the knob of FIG. 1, taken parallel to the plane of arrangement during use.

With reference to FIGS. 1-5, a knob for leveling spacer for laying wall tiles, floor tiles and the like according to the disclosure is designated generally by the reference numeral 10.

The knob 10 is applied to a leveling element 11 of a known type, which comprises a base 12, provided with a plurality of spacing raised portions 22 for the abutment of the edges of corresponding tiles, from which a stem 13 extends at right angles to said base 12 and is threaded and fixed at right angles to the base 12 in at least one breaking point 23.

The knob 10 has a substantially frustum-like tubular shape.

The two ends 14 and 15 of the knob 10, the one that faces the tile and the opposite one, in the configuration for use, therefore have different diameters.

The frustum-like side wall 17 is interposed between said two ends.

Advantageously, the side wall 17 can be cylindrical.

The knob 10 has a central female thread section 18 which is extended with an axis that coincides with the axis of extension of the frustum-like shape of the knob 10.

The central female thread section 18 is shorter than the distance between the ends 14 and 15.

The central female thread section 18 is connected to the internal face of the frustum-shaped side wall 17 of the knob 10 by means of a plurality of supporting ribs 19.

The ribs 19 extend radially from said central female thread section 18 to said side wall 17.

In this manner, the ribs 19 allow adequate redistribution of the lateral tensions in the step of removal of the knob following leveling.

The frustum-like side wall 17 is provided with grooves 21 to facilitate adequate non-slip grip.

A particularity of the disclosure is the presence, on the frustum-like side wall 17 of the knob 10, of at least one opening 16.

In the example shown in the figures, for example, the openings 16 are six.

Such openings 16 are substantially rectangular, but they can also have a different shape.

Such at least one opening 16 has the purpose of ensuring visual contact between the tile setter and the tiles during alignment.

Considering the ends 14 and 15, the first end 14, which has a smaller diameter, is annular and has a greater wall thickness than the side wall 17.

This greater thickness than the side wall 17 ensures greater resistance during the removal step.

The second end 15, which has a larger diameter, is tubular and frustum-like.

Advantageously, the second end 15, which has a larger diameter, can be tubular and cylindrical.

Substantially at the internal face of the second end 15, the ribs 19 are fixed to the side wall 17.

Figure 4A:
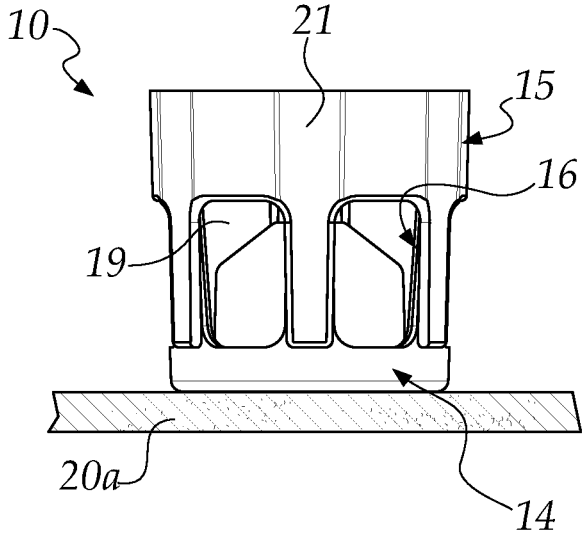
FIGS. 4*a* and 4*b* are views of two different application configurations of the disclosure.
Figure 4B:
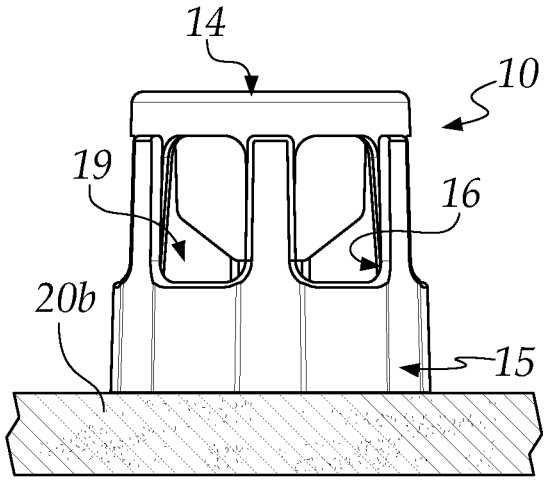

With reference to FIGS. 4*a* and 4*b*, depending on the type of tile and its thickness, the configuration of the knob 10 can be changed.

For tiles with a reduced thickness, for example up to 20 mm, the end 14, which is a smaller diameter, is arranged so as to face the tile 20*a*, as shown in FIG. 4*a*.

For thicker tiles, for example over 20 mm and up to 40 mm, the end 15, which has a larger diameter, is arranged so as to face the tile 20*b*, as shown in FIG. 4*b*.

Figure 5:
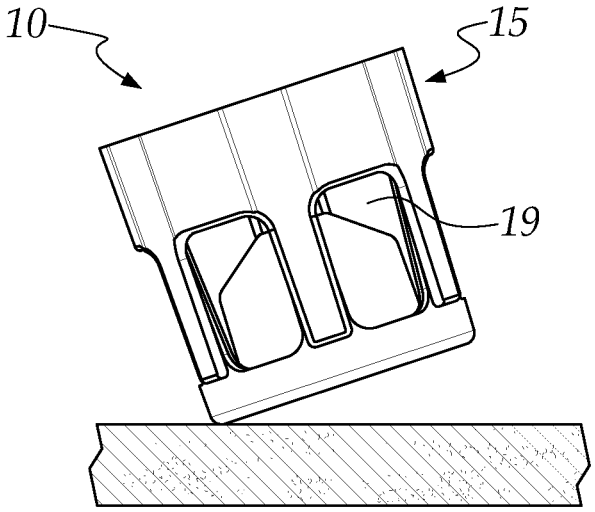
FIG. 5 is a view of the step of removal of the knob of the disclosure of FIG. 4*a* after application.

FIG. 5 is a view of the step of removal of the knob applied with the configuration shown in FIG. 4*a*.

In order to be able to remove the knob 10 screwed onto the stem 13, after the leveling step, it is sufficient to impart a blow in a direction that is perpendicular to the direction of the axis of extension of the knob 10 at the height of the end 15 that has a larger diameter.

In this manner, the frustum-like shape of the knob 10 facilitates removal by means of a lever effect.

The knob 10 is for example made of at least partially transparent plastic material.

It should be noted that the presence of openings on the frustum-shaped side wall of the knob allows continuous visual contact with the tiles during the leveling and laying step.

It should be noted that the presence of a plurality of supporting ribs for the central female thread section, connected to the frustum-like side wall substantially only at the larger-diameter end, allows to vary the configuration of the knob, which can be used both for low-thickness tiles and for thicker tiles.

It should be noted that the frustum-like shape of the knob allows faster and easier removal thereof after laying.

In practice it has been found that the disclosure achieves the intended aims and advantages by providing a knob for leveling spacer for laying wall tiles, floor tiles and the like, the spacer being of the type comprising a base with spacing raised portions for the abutment of the edges of corresponding tiles and a stem, the knob being characterized in that it has circumferential openings on the side wall.

The disclosure thus conceived is susceptible of numerous modifications and variations; all the details may furthermore be replaced with other technically equivalent elements.

In practice, the materials used, so long as they are compatible with the specific use, as well as the contingent shapes and dimensions, may be any according to the requirements and the state of the art.

What is claimed is:

1. A knob for a leveling spacer for laying tiles, the spacer having a base with spacing raised portions for the abutment of the edges of corresponding tiles and a stem, the knob comprising:

a plurality of circumferential openings on a frustum shape side wall;

a first end having a first diameter, a second end having a second diameter, the first diameter being smaller than the second diameter, and said side wall being interposed between said first end and said second end; and a central female thread section connected to an internal face of said side wall by means of a plurality of ribs, wherein said ribs have a radial extension from said central female thread section to said side wall and are fixed to said side wall substantially at an internal face of said second end.

2. The knob according to claim 1, wherein said first end is annular and has a first thickness, said side wall has a second thickness, said first thickness being larger than said second thickness.

3. The knob according to claim 1, wherein said side wall is provided with a plurality of grooves.

4. The knob according to claim 1, wherein the knob is made at least partially of transparent plastic material.

5. The knob according to claim 1, wherein said circumferential openings have a rectangular shape.

6. A knob for a leveling spacer for laying tiles, the spacer having a base with spacing raised portions for the abutment of the edges of corresponding tiles and a stem, the knob comprising:

a plurality of circumferential openings on a frustum shape side wall;

a first end having a first diameter, a second end having a second diameter, the first diameter being smaller than the second diameter, and said side wall being interposed between said first end and said second end; and a central female thread section connected to an internal face of said side wall by means of a plurality of ribs, said central female thread section being located at said second end having the larger diameter, wherein said ribs have a radial extension from said central female thread section to said side wall and are fixed to said side wall substantially at an internal face of said second end.

* * * * *